US009102134B2

(12) United States Patent
Haushahn et al.

(10) Patent No.: US 9,102,134 B2
(45) Date of Patent: Aug. 11, 2015

(54) METHOD FOR SETTING UP AND/OR OPERATING A WEB-FED PRINTING PRESS AND WEB-FED PRINTING PRESS FOR CARRYING OUT THE METHOD

(71) Applicant: HEIDELBERGER DRUCKMASCHINEN AG, Heidelberg (DE)

(72) Inventors: Volker Haushahn, Kiel (DE); Peter Melzer, Kiel (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 47 days.

(21) Appl. No.: 14/025,028

(22) Filed: Sep. 12, 2013

(65) Prior Publication Data

US 2014/0069286 A1 Mar. 13, 2014

(30) Foreign Application Priority Data

Sep. 13, 2012 (DE) ..... 10 2012 018 103

(51) Int. Cl.

| | |
|---|---|
| ***B41F 13/02*** | (2006.01) |
| ***B41J 15/16*** | (2006.01) |
| ***B41J 11/66*** | (2006.01) |
| ***B41J 15/04*** | (2006.01) |

(52) U.S. Cl.

CPC ..... *B41F 13/02* (2013.01); *B41J 11/663* (2013.01); *B41J 15/042* (2013.01); *B41J 15/165* (2013.01)

(58) Field of Classification Search

CPC ..... B41F 13/02; B41F 13/03; B41F 33/06; B41J 3/4075; B41J 15/02; B41J 15/16; B41J 11/663; B65H 2407/20; B65H 2407/21; B65H 23/1806; B65H 23/1813; B65H 18/08

See application file for complete search history.

(56) References Cited

U.S. PATENT DOCUMENTS

| | | | | |
|---|---|---|---|---|
| 3,921,043 | A * | 11/1975 | Luzio | 318/7 |
| 5,565,902 | A * | 10/1996 | Nardone et al. | 347/171 |
| 6,916,129 | B2 * | 7/2005 | Woodman | 400/109 |
| 7,144,168 | B2 | 12/2006 | Woodman | |
| 2005/0036812 | A1 | 2/2005 | Carriere et al. | |
| 2007/0145178 | A1 * | 6/2007 | Fischer et al. | 242/532 |

FOREIGN PATENT DOCUMENTS

| | | |
|---|---|---|
| EP | 1241014 A1 | 9/2002 |
| GB | 2271081 A | 4/1994 |

OTHER PUBLICATIONS

German Patent and Trademark Office Search Report Dated June 13, 2013.

* cited by examiner

*Primary Examiner* — Jill Culler
*Assistant Examiner* — Leo T Hinze
(74) *Attorney, Agent, or Firm* — Laurence A. Greenberg; Werner H. Stemer; Ralph E. Locher

(57) ABSTRACT

A method for setting up and/or operating a web-fed printing press includes winding a material web onto a roller, printing a portion of the material web, then unwinding and removing an unprinted part of the material web located before from the roller, and then fixing a cut start of the printed material web to the take-up roller. During the method, the material web is first conveyed backward for the unprinted part to be cut off, then a drive of the material web is switched to a holding mode, in which the material web stands still while maintaining web tension, the material web is drawn from a web start in direction of the take-up roller with little tensile force and the web start is fixed to the take-up roller. A web-fed printing press for carrying out the method is also provided.

7 Claims, 1 Drawing Sheet

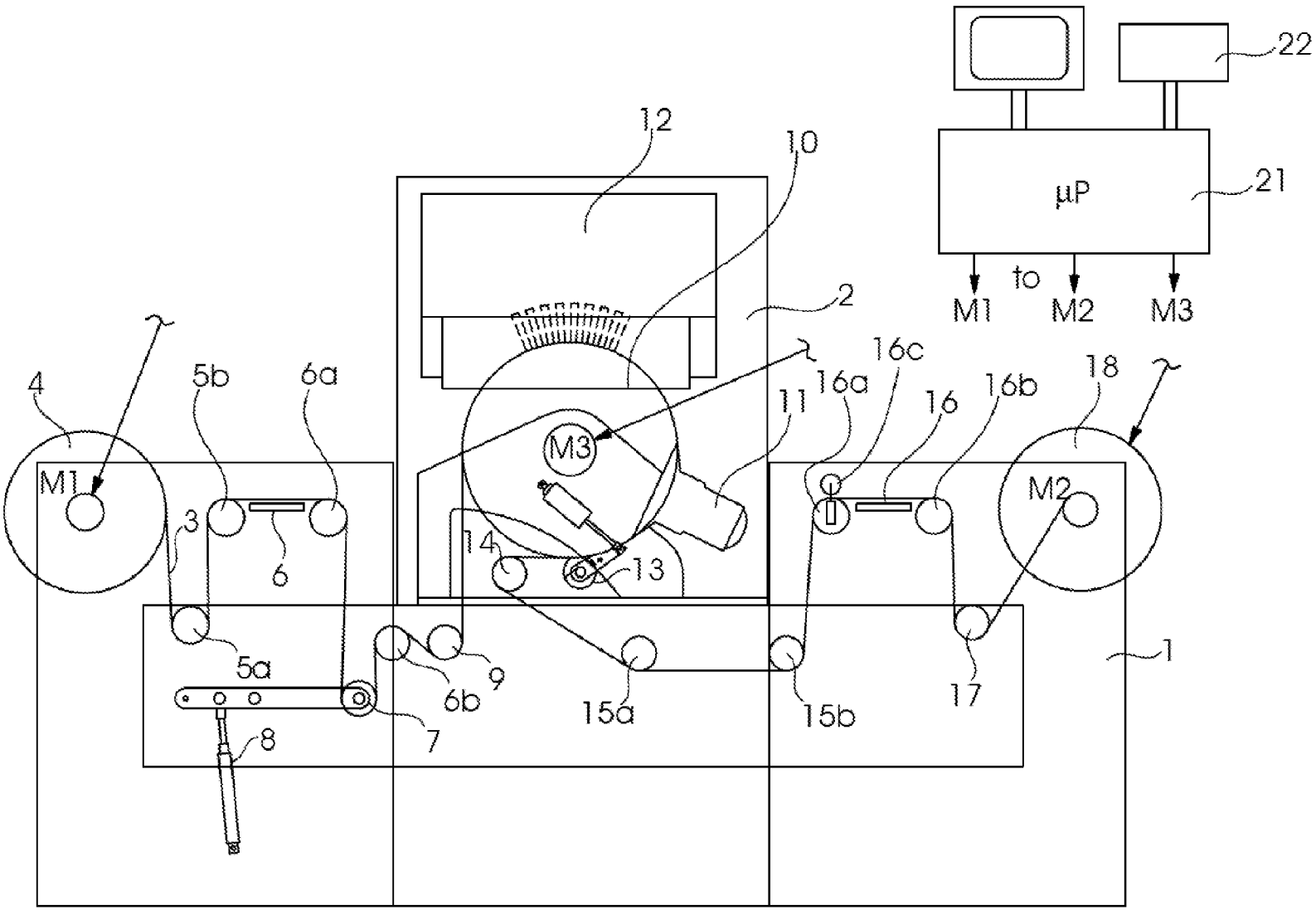
22
21
μP
M3
M2
M1
to
18
M2
1
17
16b
16
16c
16a
15b
2
10
11
12
13
M3
15a
14
9
6b
7
6a
6
5a
8
5b
3
M1
4

METHOD FOR SETTING UP AND/OR OPERATING A WEB-FED PRINTING PRESS AND WEB-FED PRINTING PRESS FOR CARRYING OUT THE METHOD

CROSS-REFERENCE TO RELATED APPLICATION

This application claims the priority, under 35 U.S.C. §119, of German Patent Application DE 10 2012 018 103.5, filed Sep. 13, 2012; the prior application is herewith incorporated by reference in its entirety.

BACKGROUND OF THE INVENTION

Field of the Invention

The invention relates to a method for setting up and/or operating a web-fed printing press in which, after printing, the printed material web is wound up onto a roller or fed to a further processing unit. The invention also relates to a web-fed printing press carrying out the method. The focus herein is less on newspaper or commercial web-fed printing presses and more on so-called narrow web-fed printing presses, such as are used for producing labels, for example, or pictorial stamps. The printing process used therein itself plays a subordinate role therein. In such narrow web-fed printing presses printing modules are used which can operate in accordance with quite different printing processes, such as inkjet, electrophotography, screen printing, gravure printing, offset or flexographic printing. Different printing processes with the appropriate modules are often also combined with one another in such a machine.

The material web with the printed labels, for example, is usually wound onto the paperboard core of a take-up roller, in order to then be processed further offline in other machines. Such web-fed printing presses for label production are offered, for example, by the company CSAT GmbH in Eggenstein, Germany under the designation ITS 600. In addition, web-fed printing presses are also known which are embedded in a larger production sequence, in which the printed labels are then detached immediately from the material web and affixed to packages, for example.

In such machines, the requirement has recently arisen to merely store only the printed labels, to wind them up or to use them in another way and not to store an interfering unprinted start of the material or to process it further at all. That requirement was previously taken into account by providing a mechanical strip accumulator in the web-fed printing press. When starting printing with the machine, printing was then first carried out into the strip accumulator until the latter had been filled. The machine was then stopped, the unprinted part of the material web was pulled off the take-up roller and cut off on a cutting table placed between strip accumulator and take-up roller. The printed start of the material web could then be pulled out of the strip accumulator and fixed to the core of the take-up roller.

However, that process has a number of disadvantages. Firstly, the adjustable torque of the take-up system determines the web tension required for the respective material. That tension must be maintained by the strip accumulator with the weight of its movable rollers. However, that equation applies to only one material whereas for other materials or web widths with a different web tension, the weights of the accumulator rollers then had to be changed. In particular, in the case of high web tensions, there is additionally the danger that, when pulling the strip by hand over the movable accumulator rollers, the web tension will rise once more, so that the material web is damaged or can even tear. In addition, in that type of accumulator, the storable length of the material web is structurally fixedly predefined. In the event that the printing press is made more flexible by adding further printing units, that leads to there no longer being sufficient printed material length available in the accumulator. In addition, such mechanical roller accumulators increase the price of such machines due to a higher mechanical expenditure.

SUMMARY OF THE INVENTION

It is accordingly an object of the invention to provide a method for setting up and/or operating a web-fed printing press and a web-fed printing press for carrying out the method, which overcome the hereinafore-mentioned disadvantages of the heretofore-known methods and printing presses of this general type and in which, when setting up or converting the printing press, an unprinted start of a material web can be removed in a straightforward manner while avoiding the aforementioned disadvantages.

With the foregoing and other objects in view there is provided, in accordance with the invention, a method for setting up and/or operating a web-fed printing press, which comprises winding the printed material web onto a roller, a portion of the material web first being printed, and an unprinted part of the material web located before then being unwound from the roller and removed, and then a cut start of the printed material web being fixed to the take-up roller. According to the invention, the material web is first conveyed backward for the unprinted part to be cut off, and then the drive of the material web is switched to a holding mode, in which the material web stops or stands still while maintaining the web tension and, from the web start, can be drawn in the direction of the take-up roller with little tensile force and fixed there.

With the objects of the invention in view, there is also provided a method for setting up and/or operating a web-fed printing press, in which the printed material web is wound up onto a roller, having a driven take-up roller, one or more printing rollers and a control system or controller for the drives of the press, before the start of the printing operation, the material web to be printed being introduced and fixed by the web start to a core of the take-up roller. According to the invention, the method comprises the following steps:

- brief printing of part of the material web introduced into the machine, at least over a web length which extends along web guides from a first printing unit or print head as far as the core of the take-up roller,
- conveying the material web backward until the start of the printed region is accessible to be cut off,
- cutting off and removing an unprinted part of the material web,
- setting the drive of the material web to torque operation in such a way that a cut end of the printed material web can be pulled in the direction of the take-up roller,
- fixing the cut end to the core of the take-up roller,
- setting the drive of the material web to conveying operation and spooling the material web forward as far as the point of the printing interruption, and
- resuming printing operation.

With the objects of the invention in view, there is concomitantly provided a web-fed printing press for carrying out the method according t the invention, which comprises an unwinding roller and a take-up roller and/or a further processing unit for the printed material web, at least one printing unit, a drive for the material web and a control system or controller, in which the drive for the material web can be controlled in a holding mode, in which it has a constant torque applied by current limitation in such a way that the torque substantially compensates for the web tension.

According to an important feature of the invention, after the first printing of part of the material web, it is firstly conveyed backward and the drive of the material web is then switched into a holding mode, in which the material web stops or stands still while maintaining the web tension. In this mode, the printed web start can be pulled in the direction of the take-up roller with little tensile force and can be fixed there. This holding mode can be brought about, for example, by limiting the current of the strip drive motor by setting the latter to operate at constant torque. In this operating mode, the torque of the drive motor compensates for the opposing moments which are applied to maintain the web tension, for example by the motors of the take-up roller or the adjustment of dancer rolls. In this way, the web stops precisely still in this mode, the unprinted end can be cut off and the printed new start of the web can be pulled very smoothly by hand to the take-up roller and fixed there.

With the method according to the invention, it is possible to dispense entirely with a mechanical roller storage device, so that all of the aforementioned problems associated therewith can, so to speak, be dispensed with "in one shot." It is expedient to provide a sensor, for example a rotary encoder, on the printing roller on which the web closely rests and by which it is driven, in order to measure the web length by which the web is firstly conveyed backward and then pulled forward again by hand. In this way, it is possible to determine how far the drive still has to spool the material web forward until the point of the printing interruption has been reached again, so that it is then possible to continue with the production, for example of labels, without any break. However, it is also possible to employ a sensor which detects the printed labels on the web optoelectronically, so that in this way an unbroken connection can be ensured.

The outlined movement sequences and drive operations of the drive motors can be integrated into the control system of a web-fed printing press very simply by using appropriate software programs. In any case, corresponding expenditure on programming is lower than the provision of mechanical roller accumulators and in addition occurs only once.

Other features which are considered as characteristic for the invention are set forth in the appended claims.

Although the invention is illustrated and described herein as embodied in a method for setting up and/or operating a web-fed printing press and a web-fed printing press for carrying out the method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

The FIGURE of the drawing is a diagrammatic, longitudinal-sectional view of a narrow, web-fed printing press, with which labels can be printed in a personalized manner.

DETAILED DESCRIPTION OF THE INVENTION

Referring now in detail to the single FIGURE of the drawing, there is seen a printing press having a housing 1, in which on one side a take-up roller 18 and on the other side an unwinding roller 4 are accommodated. Starting from the unwinding roller 4, a material web 3 is led over various deflection rollers, which form a web transport path. A printing unit 2, which is disposed approximately in the middle, has a printing roller 10 with a drive motor M3 which ensures the transport of the material web 3. The material web 3 wraps around virtually the entire circumference of this printing roller 10. An inkjet print head 12, which is disposed in an upper region, prints supplied labels on the material web 3. A dryer 11 dries the printed image to such an extent that the surface thereof can subsequently be contacted without danger by a pressure roll 13 and deflection rollers 14, 15*a* and 15*b*. The material web 3 is led over a first cutting table 6 in the web transport path between the unwinding roller 4 and the printing roller 10, following deflection by the rollers 5*a* and 5*b*. A dancer roller 7 in conjunction with two deflection rollers 6*a* and 6*b* are used in order to keep a constant web tension.

After the deflection roller 15*b*, the web is once more led over two deflection rollers 16*a* and 16*b* lying horizontally beside one another. At this point, there is a second cutting table 16, on which, as is still to be described, an unprinted piece at the start of the material web can be severed. Finally, the material web travels over a final deflection roller 17 and reaches a paperboard core of a take-up mandrel driven by a motor M2 and designated in summary as the take-up roller 18.

When adjusting the machine before starting printing, the procedure is as follows: Firstly, the material web 3 is threaded into the web guidance of the web-fed printing press and fixed to the paperboard core of the take-up roller 18. The motor M2 of the take-up roller 18 is then energized and ensures the necessary web tension in the region of the machine between the printing roller 10 and the take-up roller 18. The material web is held by the latter due to the wrap. The required moment for producing the web tension in the region of the printing press between the unwinding roller 4 and the printing roller 10 is produced by the motor M1 on the shaft of the unwinding roller 4.

Subsequently, printing is begun by a printing operation including drying being started for a restricted length of the material web 3. This length corresponds approximately to the course of the material web 3 from the first contact with the printing roller 10 as far as the paperboard core of the take-up roller 18. This value is to be viewed as a minimum value and it is recommended to plan in a reserve.

The material web is then transported backward, always with the web tension produced by the take-up roller 18, until the first printed label is located with its leading edge over the cutting table 16. There, the material web 3 is stopped over the roller 16*a* with the aid of a clamping roll 16*c* that can be pivoted out, the drive of the take-up system is switched off and the material web 3 is divided in a gap in front of the first label by a cross-cut. Then the leading unprinted section is manually pulled off and removed from the take-up roller 18. The drive servo motor M3 of the printing roller 10 is then set into torque operation by current limiting. By using the level of the impressed current, the moment can be adjusted in such a way that the drive M3 pre-tensions the material web 3 over the deflection rollers 5*a* to 9, including the dancer roll 7, as far as the unwinding roller 4, which produces an appropriate opposing moment. In this way, the web remains tensioned but does not move on its own. In this holding mode, following the release of the stopping of the web start on the cutting table 16, the material web 3 can be pulled by hand with very little tensile force, in such a manner as to take care of the material, in the direction of the take-up roller 18 over the roller 17 and stuck to the core.

If the selectable torque is too small or the value for the torque is to be made adjustable as desired, it is also possible to provide the roller 10 with a holding brake which can be engaged if necessary. The limited current for the motor M3 is then adjusted in such a way that the resultant pulling moment corresponds approximately to the braking moment. The resultant pulling moment for the movement of the web by hand can then be adjusted, by increasing the energization of the motor M3, in such a way that the pulling moment lies between the braking moment and the value 0, i.e. the material web 3 can be moved quite easily by hand without the material properties of the web 3 being changed, i.e. lengthening of, in particular, very thin web materials as a result of too high a tension does not take place.

After the leading printed end of the material web 3 has been bonded to the core of the take-up roll 18, the current limitation of the drive M3 for the holding mode is switched off again and the motor of the take-up system 18 is switched on. The machine control system is then able, by driving the material web 3 forward under control, to bring the latter into a defined position under the print head 12 in such a way that, during further printing, an unbroken connection to the interrupted first printing operation is made.

The sequence and modes described are completed by a control system 21 of the web-fed printing press, if appropriate in accordance with corresponding inputs by an operator through a keyboard 22 of the control system. A high level of flexibility is provided, since the length of the web section which is printed in the first step can be chosen freely while taking into account a minimum length necessitated by the structure for starting printing. It is therefore readily possible to lengthen the printing press described and to provide the same with further printing units. Furthermore, the process described, to be carried out at the start of printing, is independent of the web tension selected for the current web material.

The invention claimed is:

1. A method for setting up and/or operating a web-fed printing press, the method comprising the following steps:

winding a material web onto a take-up roller;

initially printing a portion of the material web;

then conveying the material web backward by unwinding an unprinted part of the material web located before the printed portion from the roller;

switching a drive of the material web to a holding mode to stop the material web while maintaining web tension;

producing a cut start of the material web;

removing the unprinted part of the material web;

drawing the material web from the cut start in direction of the take-up roller with little tensile force; and then fixing the cut start of the printed material web to the take-up roller.

2. the method according to claim 1, which further comprises in the holding mode, setting the drive of the material web to torque operation by current limitation, in which a torque of a material web drive motor compensates for a generated opposing moment to maintain the web tension.

3. The method according to claim 1, which further comprises in the holding mode, moving the cut start of the material web by hand, registering a manual movement of the material web using a sensor and storing the manual movement.

4. The method according to claim 3, which further comprises, after fixing the cut start of the printed material web to the take-up roller, ending the holding mode, switching on a drive of the take-up roller and conveying or spooling the material web forward using the drive of the material web.

5. The method according to claim 4, which further comprises spooling the material web forward by an amount registered by the sensor and then resuming a printing operation.

6. The method according to claim 4, which further comprises spooling the material web forward until the sensor detects an end of the printed portion of the material web and then resuming a printing operation.

7. A method for setting up and/or operating a web-fed printing press having drives and a controller, the method comprising the following steps:

a)introducing a material web to be printed over at least one printing roller to a driven take-up roller and fixing a web start of the material web to a core of the take-up roller before a start of a printing operation;

b) briefly printing part of the material web introduced into the printing press, at least over a web length extending along web guides from a first printing unit or print head as far as the core of the take-up roller;

c) conveying the material web backward until a start of a printed region is accessible to be cut off;

d) cutting off and removing an unprinted part of the material web;

e) setting a drive of the material web to torque operation to permit a cut end of the printed material web to be pulled in direction of the take-up roller;

f) fixing the cut end to the core of the take-up roller;

g) setting the drive of the material web to a conveying operation and spooling the material web forward as far as a point of printing interruption; and h) resuming printing operation.

* * * * *